US010184093B2

(12) United States Patent
Donnelly et al.

(10) Patent No.: US 10,184,093 B2
(45) Date of Patent: Jan. 22, 2019

(54) DECORATIVE CANDLE AND A METHOD OF MANUFACTURE

(71) Applicant: Alene Candles LLC, Milford, NH (US)

(72) Inventors: Maxim T. Donnelly, Hooksett, NH (US); Lilia M. Morales, Lee, NH (US); Thomas E. Donnelly, Bedford, NH (US)

(73) Assignee: ALENE CANDLES LLC, Milford, NH (US)

( * ) Notice: Subject to any disclaimer, the term of this patent is extended or adjusted under 35 U.S.C. 154(b) by 130 days.

(21) Appl. No.: 15/051,605

(22) Filed: Feb. 23, 2016

(65) Prior Publication Data

US 2016/0244696 A1 Aug. 25, 2016

Related U.S. Application Data

(60) Provisional application No. 62/119,560, filed on Feb. 23, 2015.

(51) Int. Cl.
*C11C 5/00* (2006.01)
*F23D 3/16* (2006.01)

(52) U.S. Cl.
CPC ..... *C11C 5/004* (2013.01); *C11C 5/008* (2013.01); *F23D 3/16* (2013.01)

(58) Field of Classification Search
CPC ..... C11C 5/004; C11C 5/008; F23D 3/16
USPC ..... 431/288
See application file for complete search history.

(56) References Cited

U.S. PATENT DOCUMENTS 3,287,484 A * 11/1966 Justus ..... C11C 5/023 431/288
3,867,173 A * 2/1975 Putzer ..... B05D 1/20 427/258
3,983,677 A * 10/1976 Lundbom ..... B44C 1/26 264/234
6,554,447 B1 4/2003 Kotary et al.
2003/0099914 A1* 5/2003 Yao ..... C11C 5/008 431/291
2004/0253558 A1* 12/2004 Chadha ..... C11C 5/008 431/291
2008/0217814 A1* 9/2008 Schitter ..... C11C 5/023 264/299

(Continued)

OTHER PUBLICATIONS

Fisher, How to Make Marbled Container Candles, About Home, http://candleandsoap.about.com/od/votivesandcontainers/ss/marbledcontain.htm, 2016.

*Primary Examiner* — Avinash Savani
*Assistant Examiner* — Rabeeul Zuberi
(74) *Attorney, Agent, or Firm* — Lawrence C. Edelman

(57) ABSTRACT

Embodiments of the present invention provide a method of making a decorative candle. According to an embodiment, the method includes disposing a dye on at least part of an inner surface of a container and providing wax, in fluid form, in a cavity of the container. The cavity is defined by a base and a sidewall, and an opening provides access to the cavity. According to another embodiment, the decorative candle comprises a candle unit comprising a core comprising a first portion of wax, and a first patterned layer comprising a dye dispersed in a second portion of the wax, the first patterned layer enclosing at least a portion of the core. The thickness of the first patterned layer is less than or equal to about 0.25 inch, and the core is substantially free of the dye.

12 Claims, 2 Drawing Sheets

(56) References Cited

U.S. PATENT DOCUMENTS

2012/0052455 A1* 3/2012 Jobelius ..... F23D 3/16
431/288

* cited by examiner

DECORATIVE CANDLE AND A METHOD OF MANUFACTURE

CROSS-REFERENCE TO RELATED APPLICATIONS

This application claims priority to U.S. provisional application No. 62/119,560 filed on Feb. 23, 2015, herein incorporated by reference.

FIELD OF THE INVENTION

Embodiments of the present invention generally relate to the field of candles and more particularly to a method of making a decorative candle.

BACKGROUND

A variety of candles ranging from aromatic candles to decorative candles are now commonplace. The candle making process has evolved in order to manufacture various such candles. Making a candle generally involves a few steps including placing a wick in a candle container, pouring wax in the container, and allowing the wax to solidify. Some candles are used with containers, while some are used without containers, in which case, as an additional step, the solidified wax and is removed from the container.

Among decorative candles, a swirl pattern is widely popular. In a swirl pattern, color mixed with the wax is spread on the candle surface to make it look like the color in the wax is swirling.

One technique used for making the swirl pattern involves poking holes into solidified wax of the candle near a side surface of the candle, placing dyes in these holes and then melting the wax near the side surface with a hot-gun. The dye placed in the holes mixes with the molten wax. On re-solidifying, the dye mixed into the wax develops into a swirl pattern. However, this process of making swirl pattern candles is handmade, and therefore, tedious. Further, the dye penetrates deep into the wax, which is a wasteful consumption of the dye because the dye that has penetrated deep into the wax does not aid in the swirl pattern or provide additional visual benefit. This handmade process does not lend itself to mechanization and automation, and therefore, is unsuitable for mass production, which remains a challenge.

Therefore, it would be desirable to have an improved method of making decorative candles.

SUMMARY

Embodiments of the present invention provide a decorative candle and a method of making the decorative candle, substantially as shown in and/or described in connection with at least one of the figures, as set forth more completely in the claims.

These and other features and advantages of the present disclosure may be appreciated from a review of the following detailed description of the present disclosure, along with the accompanying figures in which like reference numerals refer to like parts throughout.

DESCRIPTION

Embodiments of the present invention provide a method of making a candle. According to an embodiment, the method includes providing a container having an opening and a cavity, which is defined by a base and a sidewall, applying one or more dyes on at least a portion of an inner surface of the container, applying a wick in the cavity, and pouring molten (fluid) wax into the container. Upon coming in contact with the molten wax, the one or more dyes disposed on the inner surface disperse or mix in a first portion of the molten wax in proximity to the dye(s) disposed on the inner surface. Extent of dispersion of the dye(s) in the wax varies according to the temperature of the molten wax poured in the container, and the rate of cooling of the molten wax. The dye(s) are dispersed in the first portion due to convection currents in the molten (fluid) wax, and the pattern formed thereby is referred to as a "swirl pattern," and the first portion of wax mixed with the dye(s) is referred to as a patterned layer. The patterned layer has a thickness of about 0.25 inch or less. Variations in swirl patterns may be achieved by disposing the dye on the inner surface in different patterns, by varying the temperature of the molten wax, rate of cooling of the molten wax, or by stirring the molten wax. A second portion of the wax, distant from the inner surface, and to which the dye does not penetrate, forms a core of the candle. The wax cools down and solidifies resulting in a candle with a swirl pattern. In some embodiments, a portion of the dye(s) disposed on the inner surface does not mix with the wax and remains disposed over the patterned layer as such.

In some embodiments, the container is removed, leaving only the wax and dye(s) candle with the swirl pattern, also referred to as a candle unit. In other embodiments, the container is not removed and the candle includes the container, and in such embodiments the container is at least partially transparent.

Figure 1:
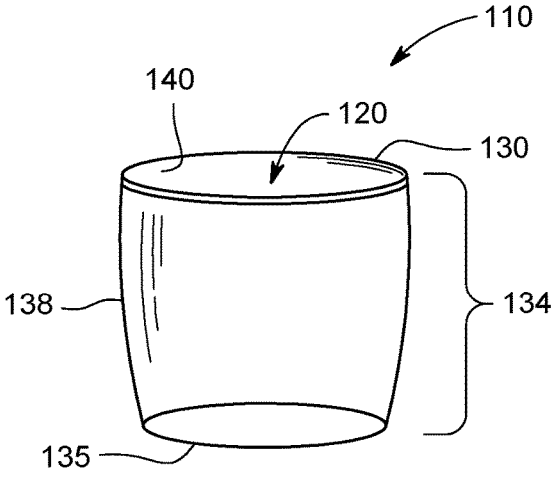
FIG. 1 depicts a container for making a decorative candle, according to one or more embodiments.

FIG. 1 depicts a container 110 used for making a decorative candle 100 (see FIG. 4), according to one or more embodiments. The container 110 is an 8 ounce transparent glass jar, and comprises a cavity 120, defined by an opening 130, a base 135 opposite the opening 130, and a sidewall 134 between the opening 130 and the base 135. The opening 130 provides access to the cavity 120. The container 110 depicted in FIG. 1 is described as anon-limiting example, and various vessels of different sizes, shapes, colors and materials may be used employing the techniques disclosed herein. In some embodiments, the container 110 is painted and/or decorated on an outer surface 138.

Figure 2:
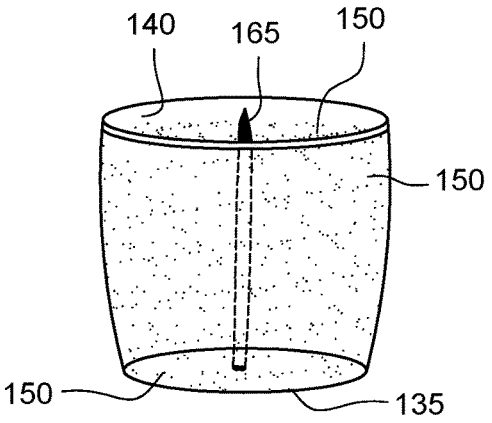
FIG. 2 depicts one or more dyes disposed on at least a part of an inner surface of the container of FIG. 1, according to one or more embodiments.

FIG. 2 depicts a dye 150 disposed on at least a part of an inner surface 140 of the container 110, according to one or more embodiments. While a single dye 150 is depicted in FIG. 2, one or more dyes 150 of different colors may be used, for example, as will be apparent from the context. The dye 150 is disposed on the inner surface 140, for example, using a sponge brush, a paint brush, a spraying machine, or other applicators as generally known in the art. For example, an automated robotic applicator may be used for disposing the one or more dyes 150 on the inner surface 140. The inner surface 140 includes the inner surface 140 corresponding to the sidewall 134 and the base 135. In some embodiments, the dye 150 is disposed on specific parts or portions of the inner surface 140, to obtain the pattern near those specific parts. In one embodiment, the dye 150 is disposed on the inner surface 140 corresponding to an upper half of the container, to obtain the pattern generally in the upper half of the candle. In another embodiment, the dye 150 is disposed on the inner surface 140 corresponding to the base 135, to obtain the pattern along the base 135.

In some embodiments, the dye 150 is a liquid dye, for example, ECO REACH liquid dye manufactured by FRENCH COLOR & CHEMICAL CO. of Englewood, N.J. In other embodiments, the dye 150 may be solid color pellets that are disposed on the inner surface 140 using known adhering means, such as a glue. According to some embodiments, the thickness of the dye 150 disposed on the inner surface 140 is determined by intensity of color desired in the pattern. For example, a thick layer of the dye 150 is used when a deep color is desired, and conversely, a thinner layer of the dye 150 is disposed when a lighter color is desired. The dimensions of the layer thickness of the dye 150 may therefore be arrived at according to the desired color depth. The variation in orientation in which the dye 150 is disposed on the inner surface 140 modifies the swirl effect that is formed. For example, the dye 150 disposed as a horizontal band having a thick layer on one end and a thin layer on the other will generate a different swirl pattern when the dye 150 is disposed as a horizontal band having a uniform thickness, or when the dye 150 is disposed as a vertical band along the sidewall. Various different initial patterns of disposing the dye 150 on the inner surface may be devised to achieve desired final swirl patterns.

According to some embodiments, the dye 150 comprises multiple dyes. In one embodiment, the dye 150 includes a first color dye (for example, red) and a second color dye (for example, blue). The two dyes are disposed on the inner surface 140 corresponding to the sidewall 134 and the base 135. Alternatively, the first color dye is disposed on the inner surface 140 corresponding to the sidewall 134, and the second color dye is disposed on the inner surface 140 corresponding to the base 135, or vice versa. Generally, the multiple dyes are disposed on the inner surface 140 such that the multiple dyes do not overlap to the extent possible or convenient for the disposing technique, however, in some cases, dyes may overlap, for example, to achieve a resulting color of two or more dyes disposed in an overlapping fashion on the inner surface 140. Various other combinations of colors of the one or more dyes 150 may be used to obtain different swirl patterns and/or color combinations in the candle. A wick 165 is affixed generally to the inner surface corresponding to the base 135 before or after disposing the dye(s) 150.

Figure 3:
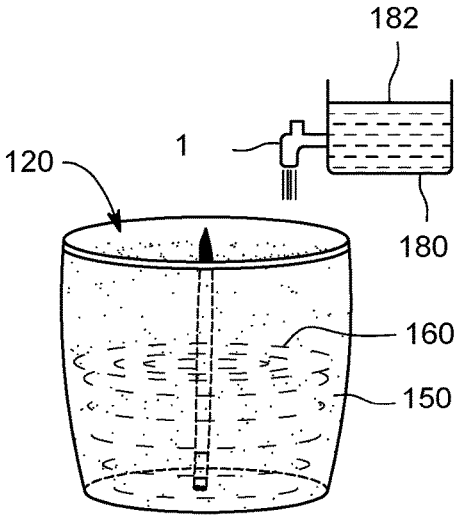
FIG. 3 depicts molten wax being disposed in a cavity of the container of FIG. 2, according to one or more embodiments.

FIG. 3 depicts wax 160, molten and therefore in fluid form, being disposed in the cavity 120, according to one or more embodiments. The molten wax 160 is disposed in the cavity 120, for example by dispensing using a dispenser 180 or otherwise pouring, wax from a batch 182 of the molten wax, for example, through a faucet 184. Various candle waxes, for example, ASTORLITE J-50 made by THE INTERNATIONAL GROUP, INC. of Ontario, Canada, or other well-known candle waxes may be used. Further, the wick 165, for example, HTP-83 and 51-32-18z zinc wick made by ATKINS & PEARCE, INC. of Covington, Ky., or any other suitable wick, is attached to the base 135, generally around the center of the base 135, however, the wick 165 may also be affixed eccentrically. The wick 165 is attached by holding with a straw, dabbing hot glue on a tab of the wick 165 and pressing the tab to the inner surface 140. Alternatively, glue dots or wick-stickums, as known in the art, may also be used to attach the wick 165. Though centre placement of the wick 165 is shown and described here for optimal burning of the candle, the wick 165 may be placed differently and more than one wick may be placed to obtain a differently designed candle. In one embodiment, the container 110 is irregularly shaped with small decorative pebbles disposed in one half of the cavity 120, and the wick 165 is placed generally in the center of the other half of the cavity 120 not having the decorative small pebbles. Pebbles along with the pattern of swirl provide the candle a different look.

Wax used for making candles is generally prepared in batches, for example the batch 182, for making a predetermined number of candles. The batch 182 comprises volume of the wax 160 required for making a predetermined number of candles. In some embodiments, fragrance and a color pellet is added and mixed in the batch 182, to achieve desired fragrant and colored wax 160, respectively. An anti-oxidant may also be added to the batch 182 to prevent the wax 160 from yellowing with time. According to one embodiment, the batch 182 is heated to a temperature ranging from about 125° F. to about 140° F. Alternatively, the batch 182 is heated to about 180° F. and subsequently cooled to a temperature ranging from about 125° F. to about 140° F. In some embodiments, the batch 182 is brought to a temperature ranging from about 130° F. to about 135° F. before being disposed in the cavity 120. Without being bound by theory, it is believed that the molten and liquid wax 160 in proximity with the inner surface 140, and therefore the dye 150, mixes with the dye 150. The convention currents in the liquid wax 160 cause the dye 150 dispersed in the liquid wax 160 to spread along the convection currents of the wax 160. As the liquid wax 160 cools and solidifies, the dye 150 now spread along the convection currents also freezes into place along with the solidified wax 160, resulting in a layer of the wax 160 mixed with the dye 150 having a visible swirl pattern, discussed further with respect to FIG. 4.

According to some embodiments, temperature of the wax 160 poured in the cavity 120 is varied to achieve different extent of dispersion and swirl patterns. It has been observed that when the wax is at higher temperatures (e.g. 150° F.), the extent of dispersion of the dye 150 within the wax 160 is higher compared to the dispersion when the wax is at a lower temperature (e.g. 130° F.).

The duration between disposing the dye 150 on the inner surface 140 and disposing the wax 160 in the cavity 120 has also been observed to have a bearing on the extent of dispersion of the dye 150 in the wax 160, and type of the dye 150 used for making the candle among others. For example, if the dye 150 is liquid and the wax 160 is disposed in the cavity 120 immediately after the dye 150 is disposed on the inner surface 140, the dye 150 will disperse more into the wax 160, than if the wax 160 is disposed in the cavity 120 after the liquid dye 150 has dried up. If the dye 150 is in form of solid pellets, the duration between disposing the dye 150 on the inner surface 140 and disposing the wax 160 in the cavity 120 does not have a significant impact on the dispersion of the dye 150 in the wax 160. However, in case of solid dyes, the extent of dispersion is generally lesser than that observed with liquid dyes.

In some embodiments, candles are made on a large scale in a manufacturing unit. In such embodiments, the time interval between disposing the dye 150 and disposing the wax 160 is determined according to efficient use and availability of resources in the manufacturing unit. For example, all resources may be directed to disposing the dye 150 on the inner surface 140 on one day, or in one work-shift, and directed to disposing the wax 160 on a subsequent day, or in a subsequent work-shift, respectively. Accordingly, in such embodiments, the duration between disposing the dye 150 and disposing the wax 160 may be one hour, or one or more days.

Figure 4:
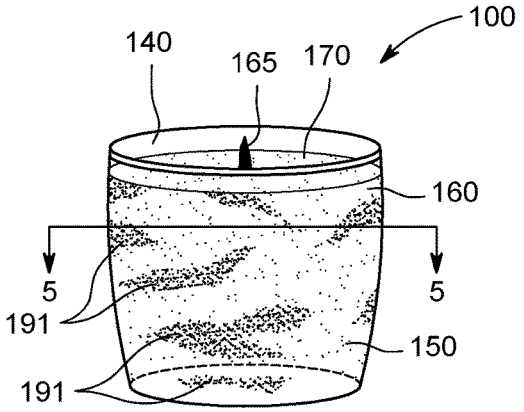
FIG. 4 depicts the candle having a first patterned layer, according to one or more embodiments.

FIG. 4 depicts the decorative candle 100 having a first patterned layer 190, according to one or more embodiments. The decorative candle 100 is formed on solidification of the molten wax 160 with the dye 150 dispersed therein, for example, as described with respect to FIG. 3. The dye 150 is mixed with the wax 160 that is close to the inner surface 140, and results in the first patterned layer 190. The first patterned layer 190 is formed from the wax 160 solidified with the dye 150 dispersed therein. Specifically, the dye 150 disperses in the wax 160 due to convection currents in the molten wax 160. Without being bound by theory, it is generally believed that the extent of dispersion, or the swirl pattern achieved, depends on convection currents in the molten or liquid wax 160. It has been observed that dispersion increases with increase in temperature of the wax 160 disposed in the cavity 120, and that the dispersion continues till the wax 160 solidifies. The liquid wax 160 may be solidified by allowing the wax 160 to cool down by keeping the decorative candle 100 in environments having a temperature below melting point of the wax 160, or by employing other cooling techniques generally known in the art.

According to one embodiment, the container 110 is maintained at a temperature lower than melting point of the wax 160, for example, by various cooling means such as fanning, spraying coolant, wrapping the container 110 in cold packs (for example, a wet towel), or cooling the environment of the container 110, among others. According to one embodiment, the dye 150 is disposed on the inner surface 140 corresponding to the sidewall 134 and the dye 150 disperses in the wax 160 along the sidewall 134. According to another embodiment, the dye 150 is disposed on the inner surface 140 corresponding to the base 135, and the dye 150 disperses in the wax 160 near the base 135.

According to some embodiments, the container 110 is transparent and the patterned layer 190 is visible while the solidified wax 160 is in the container 110. According to alternate embodiments, the solidified wax 160 having the first patterned layer 190 is removed from the container 110, and in such embodiments, the container 110 may be opaque.

Figure 5:
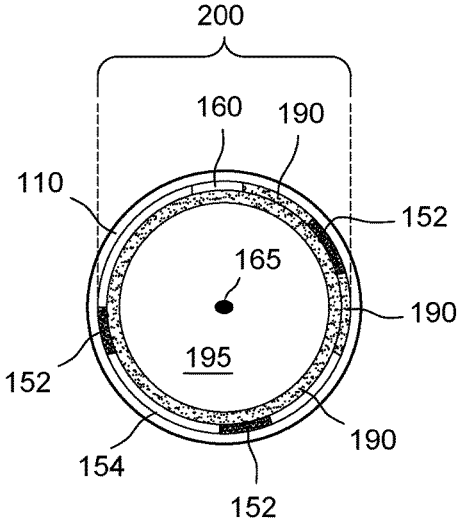
FIG. 5 depicts a cross section along an axis 5-5 of the candle of FIG. 4, according to one or more embodiments.

FIG. 5 depicts the cross section along an axis 5-5 of the decorative candle 100 of FIG. 4, according to one or more embodiments. The decorative candle 100 comprises the container 110, and a candle unit 200 comprising a core 195, the wick 165, the first patterned layer 190, and the dye 150 disposed on the first patterned layer 190. While concentric rings are shown to demarcate boundaries between the core 195 and the patterned layer 190, no actual rings or boundaries exist in the decorative candle 100. Further, the boundaries may not be uniformly concentric. Since the dye 150 disperses in the wax 160 in proximity to the inner surface 140, the decorative candle 100 comprises two portions of the wax 160, the first portion in which the dye 150 is dispersed and forms the first patterned layer 190, and a second portion in which the dye 150 is not dispersed, and the second portion forms the core 195. The dye 150, dispersed in the first patterned layer 190 form the pattern 191, for example the swirl pattern. The core 195 comprises the second portion of the wax 160, and is substantially free of the dye 150. According to an embodiment, thickness of the first patterned layer 190 is less than or equal to about 0.25 inches. Without being bound by theory, it is believed that the pattern 191 arises from the dispersion of the dye 150 in the molten wax 160 is localized to the inner surface. It has been observed that the depth of the dispersion, and therefore the thickness of the patterned layer 190, increases with an increase in the temperature of the molten wax 160 provided to the cavity 120. In some embodiments, a thickness of about 0.25 inches or less is achieved by keeping the temperature of the molten wax 160 provided in the cavity to about 140° F. or less. The lower thickness of the patterned layer 190 consumes lower dye than, for example, prior art candles, in which the dye disperses deep into the candle, for example, more than 0.5 inches in some instances.

Without being bound by theory, it is believed that all of the dye 150 disposed on the inner surface 140 does not disperse in the wax 160. A portion 152 of the dye 150 that does not disperse in the wax 160 of the patterned layer 190 is thereby disposed between the inner surface 140 and the first patterned layer 190. The portion 152 disposed between the first patterned layer 190 and the inner surface 140 is a very thin layer of the dye 150 unmixed with the wax 160. Further, the portion 152 of the dye 150 unmixed with wax is shown as a part of an outer layer 154 for clarity. The outer layer 154 is generally a very thin layer to which the portions of patterned layer 190 generally extend, and may also include the wax 160 unmixed with the dye 150. The drawings are not to scale and the relative thickness of various layers may vary. The layers are depicted for the purposes of explanation, no physical layers are expected to exist within the body of the candle unit 200, which is a continuum of wax only, dye dispersed in wax and dye only, for example, as discussed above. In some embodiments, the outer layer 154 is generally very thin and mostly transparent or translucent so as to not obscure the pattern 191 of the patterned layer 190. Such a structure is different, for example, from prior art candles in which dye used for making patterns is inserted in holes made in the wax, and as a result, the dye fully mixes into the wax, without leaving any portion of the dye unmixed with the wax.

According to one embodiment, the container 110 is removed to obtain the candle unit 200 comprising the core 195, the first patterned layer 190 enclosing at least a portion of the core 195 and the one or more dyes, unmixed with the wax, disposed on the first patterned layer 190.

Figure 6:
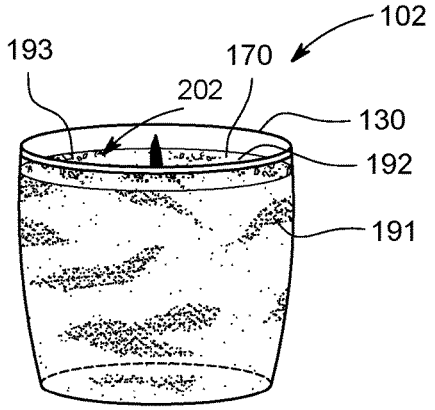
FIG. 6 depicts the candle of FIG. 4 having a second patterned layer, according to one or more embodiments.

FIG. 6 depicts the decorative candle 100 of FIG. 4, additionally having a second patterned layer 192, according to one or more embodiments, and therefore, the decorative candle 100 is depicted as a candle 102 comprising a candle unit 202 (similar to the candle unit 200) comprising the wick 165, the core 195, the first patterned layer 190, and the outer layer 154. The second patterned layer 192 is disposed on atop surface 170 of the candle unit 202, the top surface 170 facing the opening 130. The second patterned layer 192 is formed by brushing the dye 150 (or a dye of different color than the dye 150) on at least a part of the top surface 170, melting the wax at the top surface 170 and re-solidifying the molten wax to form the second patterned layer 192. The dye 150 disposed in the at least part of the top surface 170 disperses in a third portion of the candle unit 202 near the top surface 170. On re-solidification, the dye 150 dispersed in the third portion of the candle unit 202 forms the second patterned layer 192 with a pattern 193. According to one embodiment, the dye(s) 150 comprise two dyes, the first color dye and the second color dye, and the first color dye is dispersed in the first patterned layer 190, and the second color dye is dispersed in the second patterned layer 192.

Figure 7:
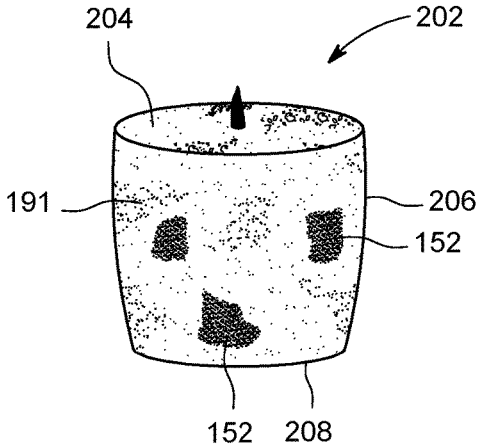
FIG. 7 depicts a candle unit of the candle of FIG. 6 without the container, according to one or more embodiments.

FIG. 7 depicts the candle unit 202 of the candle 102 of FIG. 6 without the container, according to one or more embodiments. The candle unit 202 has a top 204, a side 206, and a base 208 corresponding to the opening 130, the sidewall 134 and the base 135 of the container 110. The candle unit 202 includes the pattern 191 of the first patterned layer 190, for example, as described with respect to FIGS. 4-6, and the portions 152 of the dye 150 unmixed with the wax 160.

Various techniques for making the decorative candle 100 described above includes steps that can be used readily or customized for large scale production of candles having the pattern 191 and/or the pattern 193, as would occur to those readily skilled in the art. For example, variation in the patterns 191 and 193 may be achieved by controlling the temperature of the wax, the temperature of the container 110 and/or the ambient temperature of the container 110, any of which can be easily mechanized. Also, the application of dye(s) on the inner surface of the container or the top surface of the candle unit lends itself to automation, for example, by using programmable spray machines, and therefore to large scale production of the candles. Using the techniques described according to various embodiments, decorative candles having a swirl pattern can be produced on a large scale. Those skilled in the art will recognize that several variations, modifications, additions, and improvements to the techniques and structures described herein may fall within the scope of embodiments as defined in the claims that follow.

While the foregoing is directed to embodiments of the present invention, other and further embodiments of the invention may be devised without departing from the basic scope thereof, and the scope thereof is determined by the claims that follow.

What is claimed is:

1. A method for making a decorative candle, comprising:
disposing a liquid dye colorant on at least part of an inner surface of a container, the container having a cavity defined by a base and a sidewall, and an opening providing access to the cavity; and
providing wax in the cavity, the wax being in fluid form, wherein the dye is directly disposed on the at least part of the inner surface before providing the wax, and
wherein when providing the wax into the cavity, the cavity is caused to be at a first temperature which is below the melting point of the wax, and the fluid wax is caused to be at a second temperature which is above the melting point of the wax, the difference between said second and first temperatures being selected so as to cause the fluid wax adjacent the sidewall of the cavity to solidify into a cylindrical layer about the outer perimeter of the candle which limits dispersion of said dye to within said cylindrical layer during the making of said decorative candle.

2. The method of claim 1, wherein when providing wax in the cavity, the wax is at a temperature ranging from about 125° F. to about 140° F.

3. The method of claim 1, wherein when providing wax in the cavity, the wax is at a temperature ranging from about 130° F. to about 135° F.

4. The method of claim 1, wherein the method causes said layer to be less than 0.25" thick.

5. The method of claim 4, further comprising removing the wax from the container after solidification.

6. The method of claim 1, further comprising maintaining the container at a temperature lower than the melting point of the wax.

7. The method of claim 1, wherein at least part of the container is transparent.

8. The method of claim 1, wherein the dye comprises at least two liquid dyes of different colors.

9. The method of claim 4 further comprises:
disposing the dye on at least part of a top surface of the wax, the top surface being a surface of the wax exposed by the opening; and
melting the wax at the top surface.

10. The method of claim 9, wherein the dye comprises a first color dye and a second color dye, the first color dye disposed on the at least part of the inner surface, and the second color dye disposed on the at least part of the top surface.

11. The method of claim 9 further comprising re-solidifying the wax at the top surface.

12. The method of claim 11 further comprising removing the container after the re-solidification.

* * * * *